US007649147B2

(12) United States Patent
Xiao

(10) Patent No.: US 7,649,147 B2
(45) Date of Patent: Jan. 19, 2010

(54) OFF-CIRCUIT TAP CHANGER DEVICE

(76) Inventor: Riming Xiao, 3073 Lawrence Expressway, San Jose, CA (US) 95051

( * ) Notice: Subject to any disclaimer, the term of this patent is extended or adjusted under 35 U.S.C. 154(b) by 150 days.

(21) Appl. No.: 11/900,739

(22) Filed: Sep. 14, 2007

(65) Prior Publication Data

US 2009/0071806 A1 Mar. 19, 2009

(51) Int. Cl.
*H01H 19/00* (2006.01)

(52) U.S. Cl. ..... 200/11 TC

(58) Field of Classification Search ..... 200/11 TC, 200/18, 275, 8 A, 11 B, 5 R; 323/254, 255, 323/340, 341
See application file for complete search history.

(56) References Cited

U.S. PATENT DOCUMENTS 3,176,089 A * 3/1965 Bleibtreu et al. ..... 200/18
4,496,805 A * 1/1985 Duenke ..... 200/11 TC
6,849,813 B1 * 2/2005 Albrecht ..... 200/11 TC

* cited by examiner

*Primary Examiner*—Edwin A. Leon
(74) *Attorney, Agent, or Firm*—Jingming Cai; Schein & Cai LLP

(57) ABSTRACT

An off-circuit tap changer device which includes a spring-biased moving contact that is operable to independent flex and roll. The moving contact includes one or more rings which are independently spring biased to a moving contact support. The device also includes a single rod with locking elongated ribs to mate with a sleeve of the moving contact support. The circulating circuit includes X stationary contacts. The resiliency via the spring-biasing and the rolling of the ring minimizes, if not prevents, surface wearing of the moving contacts.

22 Claims, 11 Drawing Sheets

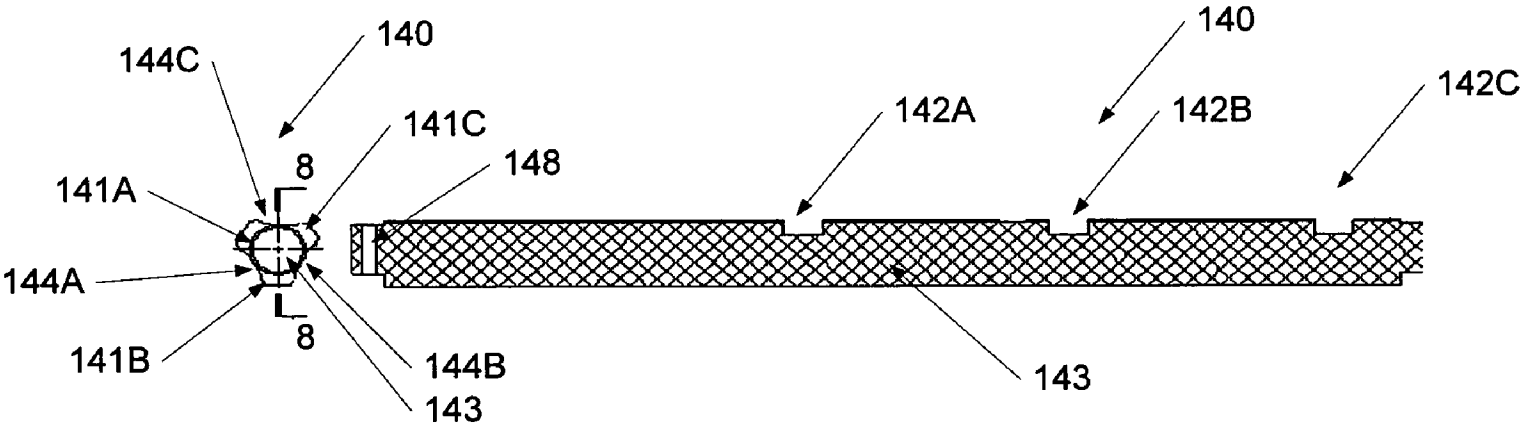
FIG. 8
FIG. 7
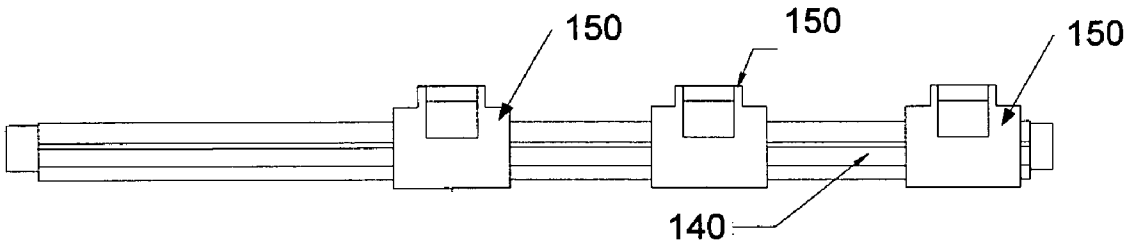
FIG. 9

OFF-CIRCUIT TAP CHANGER DEVICE

BACKGROUND

I. Field

The present invention relates generally to transformers and more particularly to an off-circuit tap changer used to adjust with a rolling, spring-biased moving contact the output voltage of a transformer by changing its tap winding when the transformer is de-energized.

II. Background

FIG. 1 is a view of a conventional off-circuit tap changer system 10. The system 10 includes in general a drive mechanism 18 coupled to an off-circuit tap changer device 20. A transformer tank 5 is coupled to the system 10 between the drive mechanism 18 and the off-circuit tap changer device 20. The drive mechanism 18 includes a handle 16.

An off-circuit tap changer device 20 is used to adjust the output voltage of a transformer by changing its tap winding when the transformer is de-energized. For a three-phase transformer, the conventional tap changer device 20 is a three-phase switch, with six (6) stationary contacts 25 in each phase (5 operating positions) evenly configured over 180°. There is one moving contact 30 for each phase installed on a main shaft assembly 40.

FIG. 2 is a cross-sectional view of a conventional tap changer device 20 and FIG. 3 is an end view schematic of the device 20 along the plane 3-3 of FIG. 2. The off-circuit tap changer device 20 includes a plurality of circulating circuits 22A, 22B and 22C, each of which is comprised of one moving contact 30 and an array of stationary contacts 25. As a frame of reference, in the view of FIG. 2, the moving contact 30 is in contact with a pair of adjacent stationary contacts 25A and 25B. Through driving, by the rotation of the main shaft assembly 40, the moving contact 30 rotates with the main shaft assembly 40 to an angle to mate with another pair of stationary contacts in the array of stationary contacts 25, thus finishing a tap changing operation. Structure characteristics of the moving contact 30 is of a sector structure.

The motion of the moving contact 30 of the conventional off-circuit tap changer device 20, during tap changing, is a sliding motion. This construction causes more wear between the curved surface of the moving contact 30 and the contacting surfaces of the two adjacent stationary contacts 25; and leads to improper contact condition. The array of stationary contacts 25 is supported by parallel insulating panels 35.

Another disadvantage of the conventional off-circuit tap changer device 20 is the main shaft assembly 40. The main shaft assembly 40 includes a plurality of insulating pipe sections 42A, 42B and 42C. In this example, there are three insulating pipe sections. The construction of the main shaft assembly 40 with the plurality of insulating pipe sections 42A, 42B and 42C increases the machining job load and installation tolerance of the tap changer device 20. Furthermore, the installation or assemblage of these pipe sections 42A, 42B and 42C to construct the main shaft assembly 40 is generally complicated.

Each of the plurality of circulating circuits 22A, 22B and 22C is integrated with a metal connector 45 which is inline between adjacent insulating pipe sections. The alternating pipe section and connector configuration creates the main shaft assembly 40 to be rotated.

Thus, there is a need for techniques for adjusting the output voltage of a transformer with minimum surface wearing between the moving contact and the stationary contact.

SUMMARY OF THE INVENTION

In one configuration of the present invention, a device comprising a main shaft adapted to be rotated is provided. The device also includes a plurality of circulating circuits coupled to the main shaft, each circulating circuit having a spring-biased moving contact operable to flex and independently roll about an array of stationary contacts to adjust an output voltage of a transformer by changing its tap winding when the transformer is de-energized.

The device of the present invention contemplates a configuration having a spring-biased moving contact which comprises one or more rings in parallel and each ring being independently spring-biased. The number of moving contacts may be subject to the rated current of the transformer. In some cases the rated current is very small. Thus, only one ring may be needed.

The device of the present invention further contemplates a main shaft comprises an elongated rod structure having an outer circumferential surface with a plurality of elongated ribs spaced circumferentially therearound, a top side and a bottom side. The circumferential surface includes N recesses in the top side, where N corresponds to the number of transformer phases. The number of tap changer phases corresponds to the number of transformer phases. For single phase tap changer, there is only one recess.

In one configuration of the invention, a system is provided which comprises a drive mechanism having a handle. The system also includes a main shaft adapted to be rotated by the drive mechanism. Furthermore, a plurality of circulating circuits are included which are coupled to the main shaft, each circulating circuit having a spring-biased moving contact operable to flex and independently roll about an array of stationary contacts to adjust an output voltage of a transformer by changing its tap winding when the transformer is de-energized.

These and various other features as well as advantages, which characterize the present invention, will be apparent from a reading of the following detailed description and a review of the associated drawings.

BRIEF DESCRIPTION OF THE DRAWINGS

Aspects and embodiments of the disclosure will become more apparent from the detailed description set forth below when taken in conjunction with the drawings in which like reference characters identify correspondingly throughout.

FIG. 7 shows an end view of the main shaft.

FIG. 8 shows a cross-sectional view along the plane 8-8 FIG. 7.

FIG. 9 shows a side view of the main shaft with the moving contact supports installed.

DETAILED DESCRIPTION

The word "exemplary" is used herein to mean "serving as an example, instance, or illustration." Any configuration or design described herein as "exemplary" is not necessarily to be construed as preferred or advantageous over other configurations or designs.

Figure 1:
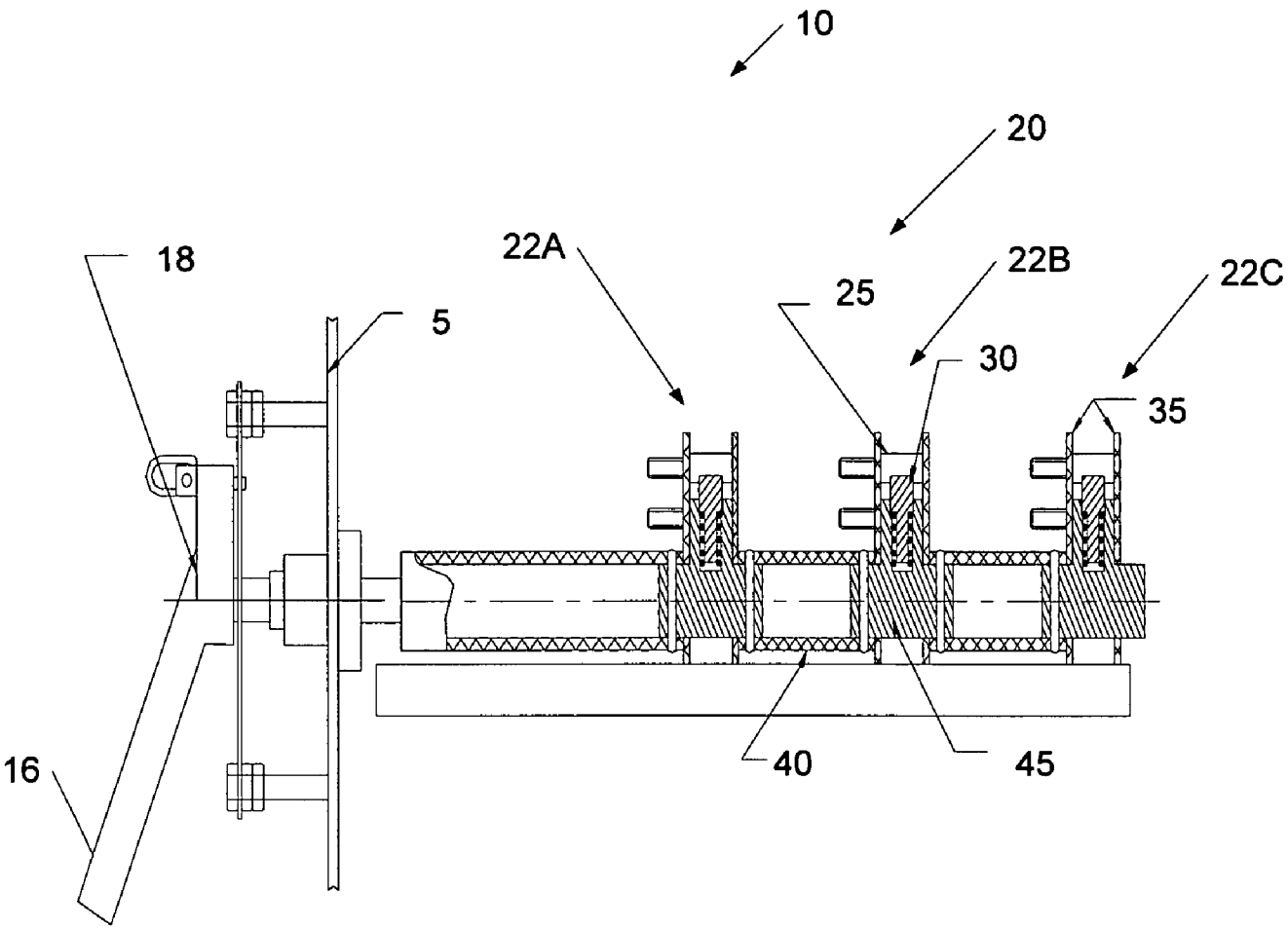
FIG. 1 PRIOR ART
FIG. 1 shows a view of a conventional off-circuit tap changer system.
Figure 3:
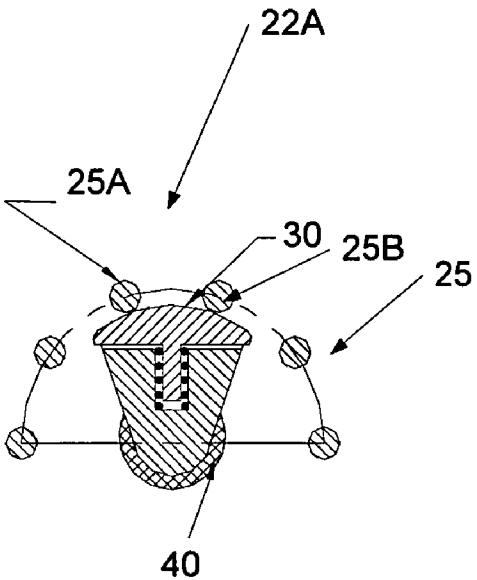
FIG. 3 PRIOR ART
FIG. 3 shows an end view schematic of the device 20 along the plane 3-3 of FIG. 2.
Figure 2:
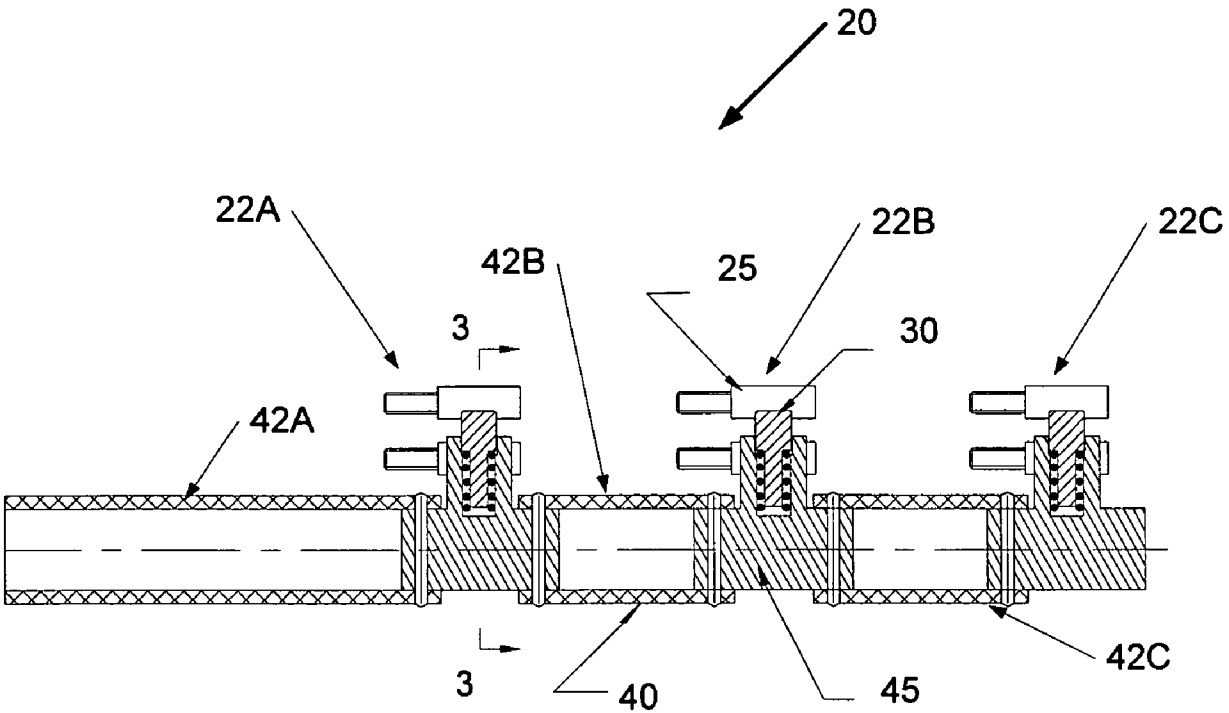
FIG. 2 PRIOR ART
FIG. 2 shows a cross-sectional view of a conventional tap changer device 20.
Figure 4:
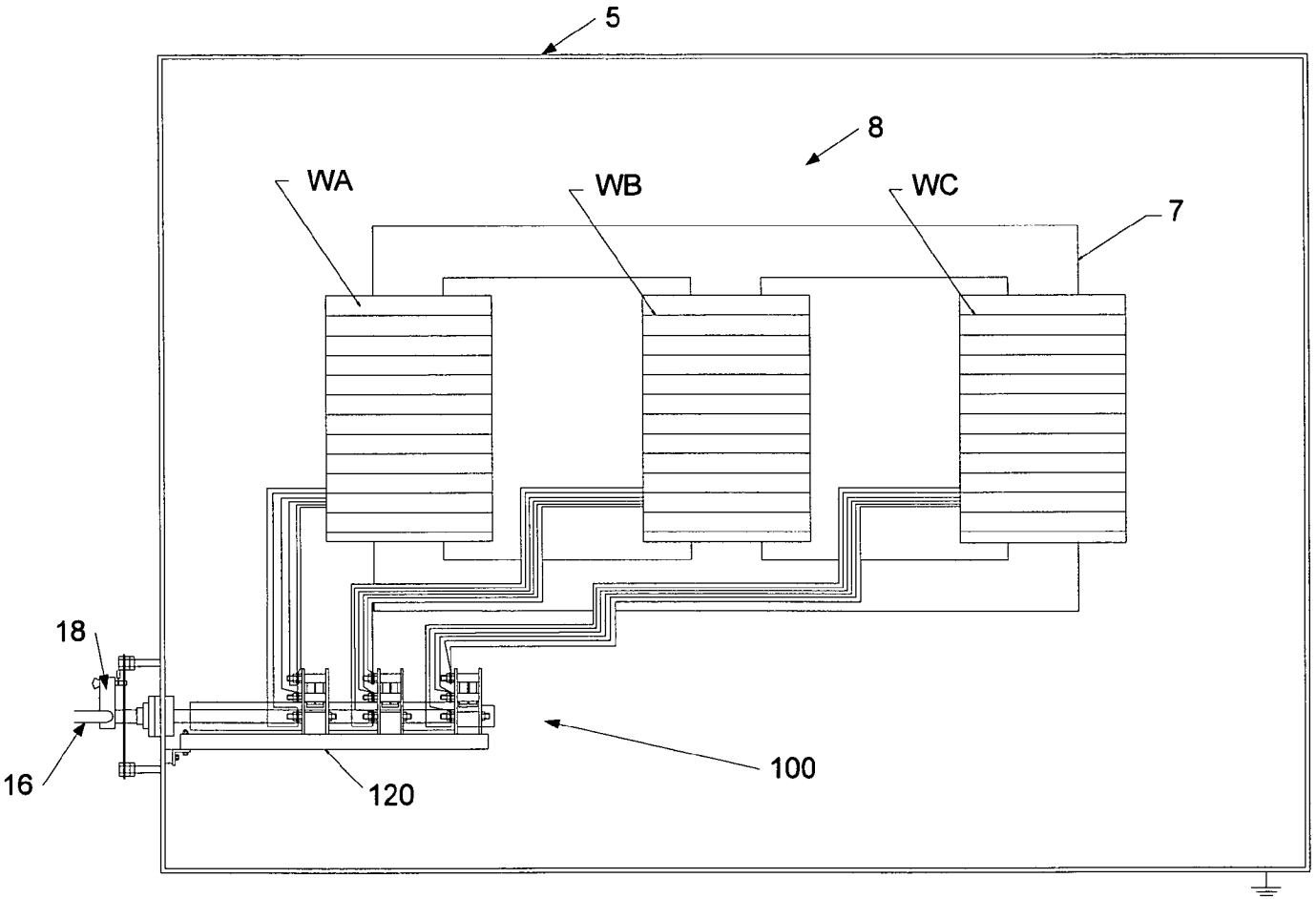
FIG. 4 shows a view of an off-circuit tap changer system being deployed to adjust the output voltage of a transformer in accordance with the present invention.

FIG. 4 shows a view of a tap changer system 100 being deployed to adjust the output voltage of a transformer 8 denoted by winding WA, winding WB, and winding WC. Thus, the exemplary transformer 8 has three phases. The windings WA, WB and WC are coupled to a steel core 7. The system 100 includes in general a drive mechanism 18 coupled to an off-circuit tap changer device 120. A transformer tank 5 is coupled to the system 100 between the drive mechanism 18 and the off-circuit tap changer device 120. The drive mechanism 18 includes a handle 16.

Figure 5:
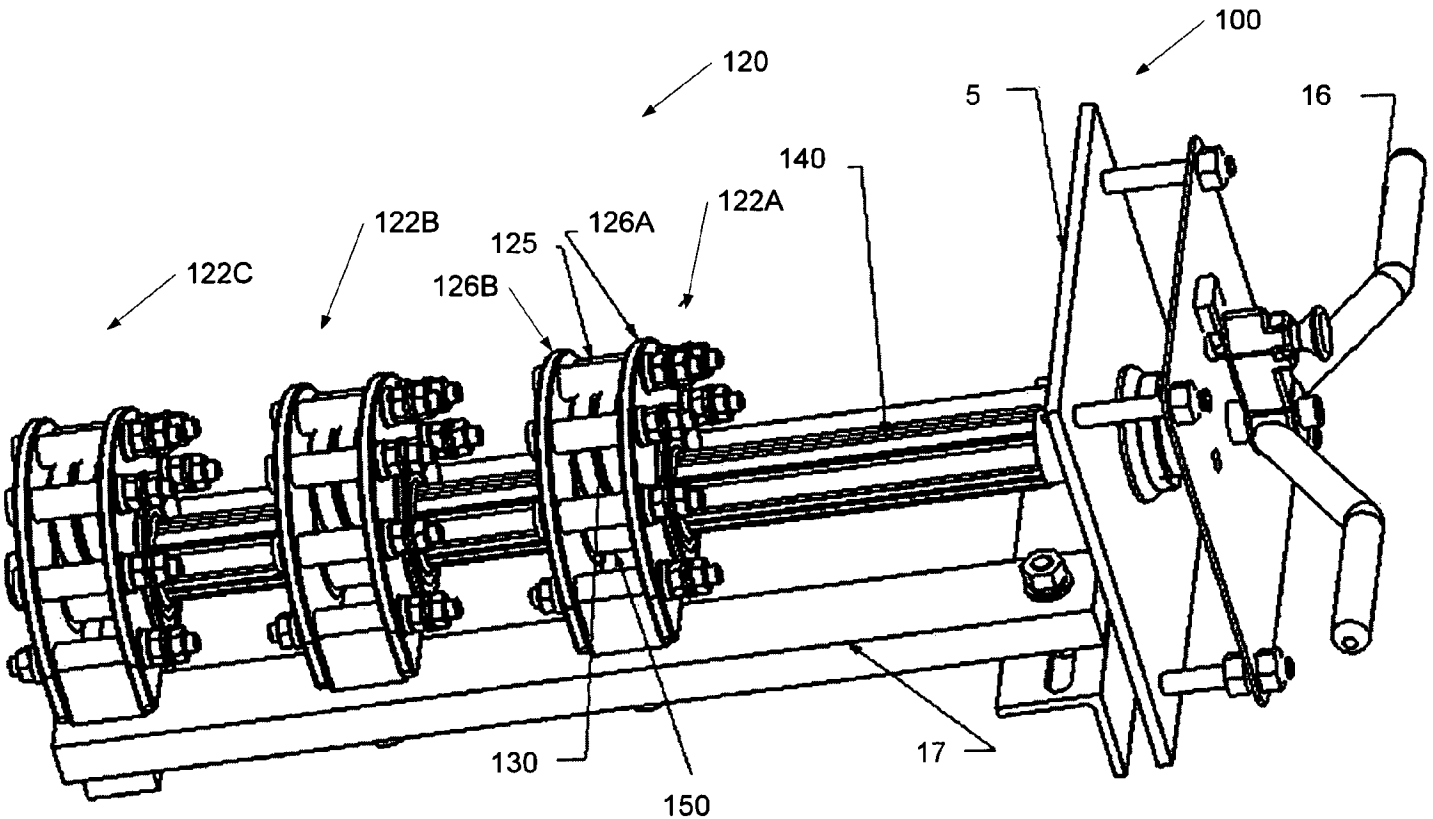
FIG. 5 shows a perspective view of the tap changer device in accordance with the present invention.
Figure 6:
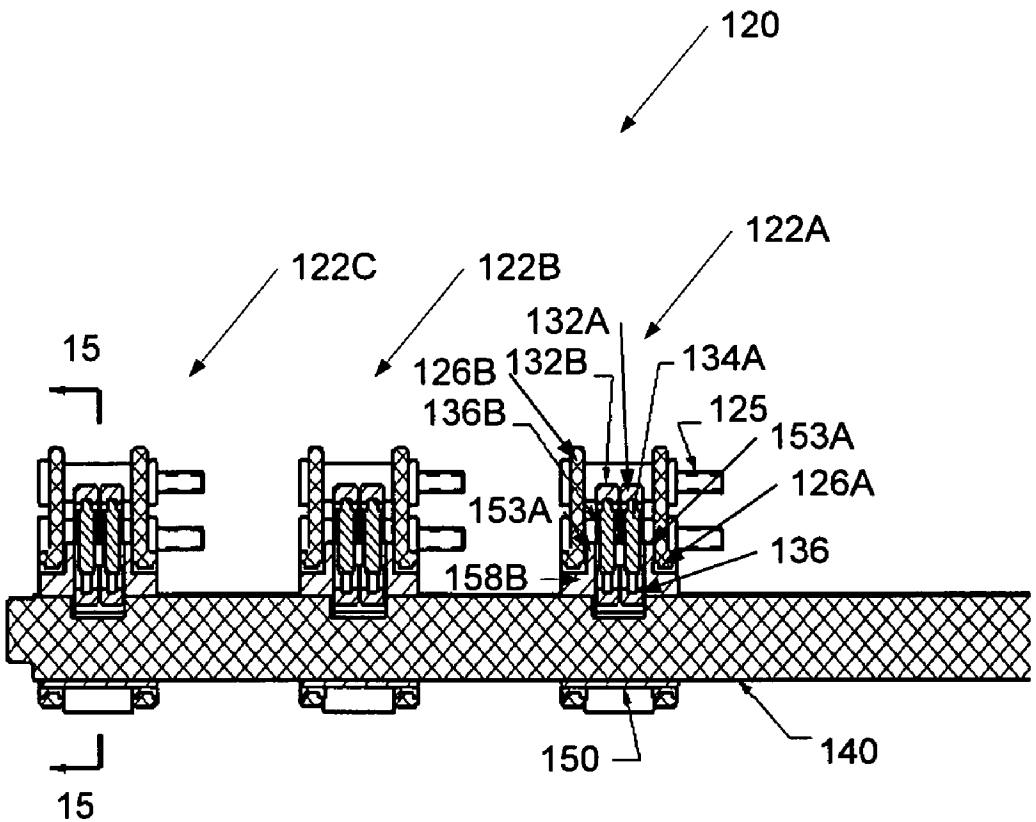
FIG. 6 shows partial view of the tap changer device in accordance with the present invention.

FIGS. 5 and 6 show a perspective view and partial view of the tap changer device 120, respectively, in accordance with the present invention. The tap changer device 120 is used in the system 100 with the drive mechanism 18 and transformer tank 5. The off-circuit tap changer device 120 includes a plurality of circulating circuits 122A, 122B and 122C and a main shaft 140. The plurality of circulating circuits 122A, 122B and 122C includes at least one rolling, spring-biased moving contact 130. As will be seen from the description below, the motion of the moving contact 130 includes a rolling motion instead of a sliding motion.

For each circulating circuit 122A, 122B and 122C, the off-circuit tap changer device 120 further includes a corresponding array of stationary contacts 125 supported by parallel insulating (supporting) panels 126A and 126B. The parallel insulating (supporting) panels 126A and 126B position the array of stationary contacts 125 approximately 180° above around the main shaft 140 so that the moving contacts 130 engage the stationary contacts 125. A bottom end of the parallel insulating panels 126A and 126B are mounted to a crossbar member 17 which fixes the position of parallel insulating (supporting) panels 126A and 126B. Additional features of the circulating circuit 122A, 122B and 122 will be described in detail later.

In operation, as the handle 16 is rotated, the main shaft 140 is rotated. Thus, the details of the main shaft 140 will first be described.

FIG. 7 is an end view of the main shaft 140 and FIG. 8 is a cross-sectional view along the plane 8-8 FIG. 7. The main shaft 140 is made of epoxy fiberglass pultrusion rod with strong mechanical strength and has a tri-petal shape. Nevertheless, other strong and durable materials may be used. As best seen in FIG. 7, the main shaft 140 includes an elongated solid structure 143 with a plurality of spaced concaved elongated trenches 144A, 144B and 144C formed therein. The solid center section of the elongated solid structure 143 is denoted by a circle. Each concaved elongated trench 144A, 144B and 144C has an apex which lies on or nearly on the perimeter of the circle. Each concaved elongated trench 144A, 144B and 144C is separated by an elongated rib 141A, 141B, and 141C. This configuration defines the "tri-petal shape."

As a point of reference, there are three elongated ribs which are evenly spaced in the outer perimeter of the main shaft 140. The top side of the main shaft 140 includes two of the elongated ribs 141A and 141C while the bottom side has only one of the ribs 141B. Nevertheless, more or less elongated ribs may be used.

The main shaft 140 further includes a plurality of channels or recesses 142A, 142B and 142C spaced longitudinally and formed in a top side of the elongated solid structure 143. Each channel or recess 142A, 142B and 142C has constructed and arranged to allow the moving contact 130 to freely rotate therein, as will be described in more detail later. There are N channels or recesses 142A, 142B and 142C where N is the number of transformer phases. Thus, for a three-phase transformer, N is equal to three. Hence, the number of channels or recesses 142A, 142B and 142C will vary based on the number of transformer phases.

End 145 of the main shaft 140 is adapted to be coupled to the transformer tank 5 and the drive mechanism 18 in a conventional manner. The end 145 has a hole 148 for fastening.

FIG. 9 shows a side view of the main shaft 140 with the moving contact supports 150 installed. The off-circuit tap changer device 120 further comprises a plurality of moving contact supports 150, each moving contact support being positioned and aligned with a respective one of the plurality of channels 142A, 142B and 142C spaced longitudinally in a top side of the elongated solid structure 143. Since each moving contact support is essentially the same only one such moving contact support will be described in detail.

Figure 11:
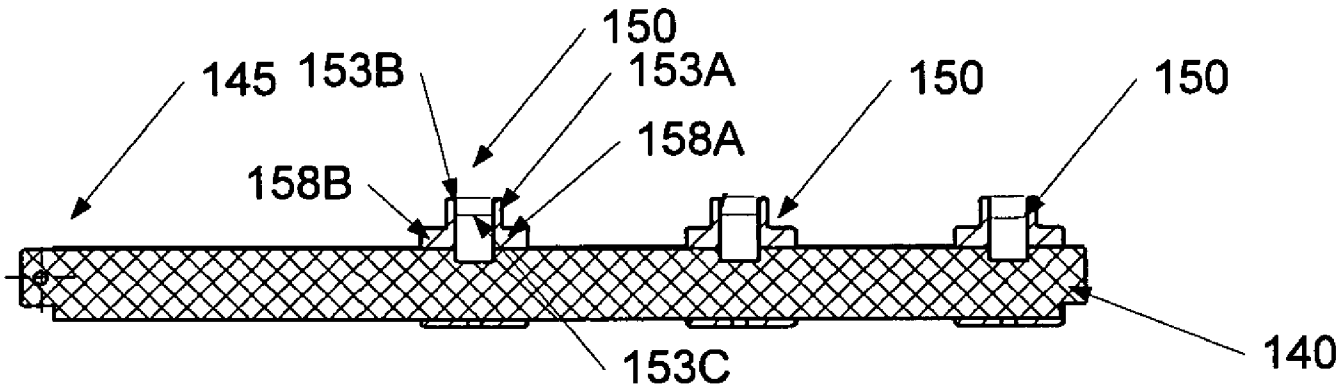
FIG. 11 shows a cross-sectional view along the plane 8-8 of FIG. 10.
Figure 10:
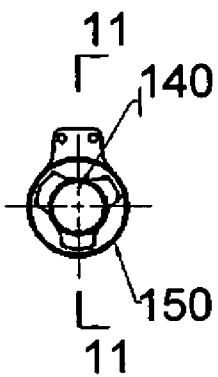
FIG. 10 shows an end view of the main shaft with the moving contact supports of FIG. 9.
Figure 13:
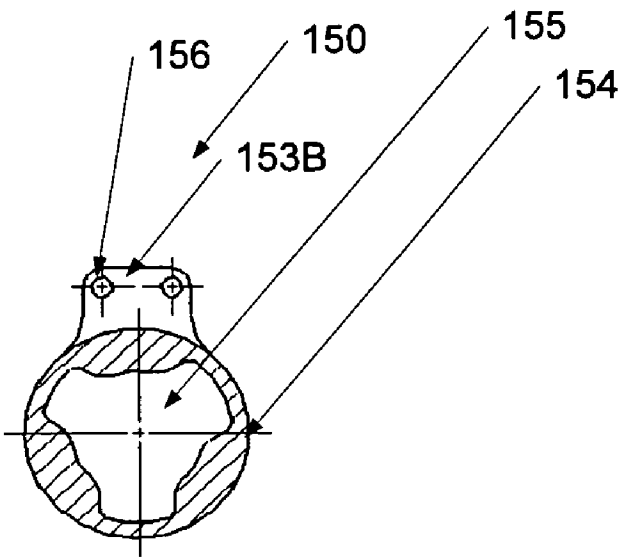
FIG. 13 shows a cross-sectional view along the plane 13-13 of FIG. 12.
Figure 12:
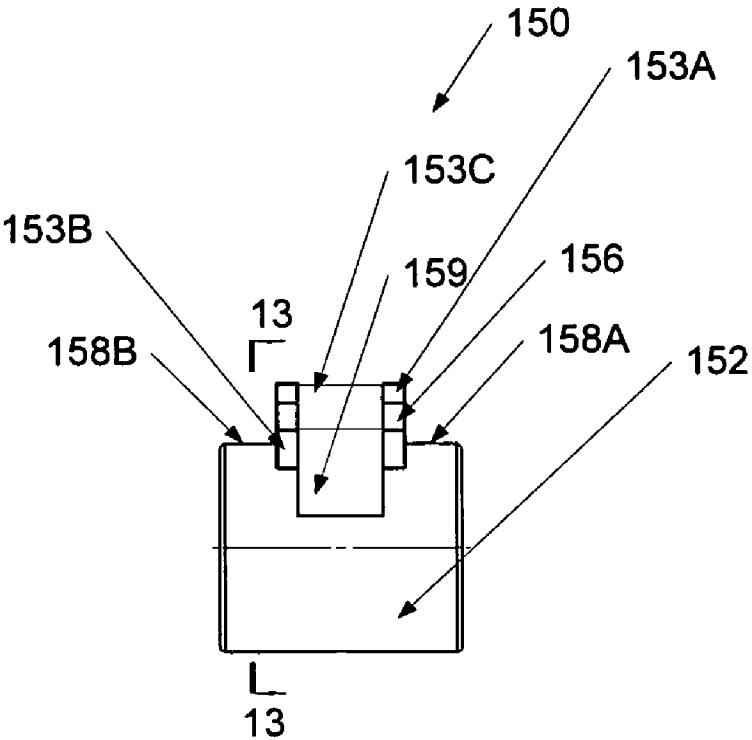
FIG. 12 shows a front view of the moving contact support of FIG. 9.

FIG. 10 shows an end view of the main shaft 140 with the moving contact supports 150 of FIG. 9 and FIG. 11 shows a cross-sectional view along the plane 11-11 of FIG. 10. FIG. 12 is a front view of the moving contact support 150, shown in FIG. 9, and FIG. 13 is a cross-sectional view along the plane 13-13 of FIG. 12. The moving contact support 150 has a sleeve 152 having a generally circular outer perimeter 154 with a hollow center 155 having a tri-petal shape contour. The tri-petal shape contour of the hollow center 155 closely tracks the tri-petal shape of the outer perimeter of the main shaft 140 so that it may be secured into place and will not rotate about the longitudinal center of the main shaft 140.

While the illustrated configuration provides a tri-petal shape contour, a four-petal shape (four-leaf clover) may be substituted. Likewise, the elongated ribs 141A, 141B, and 141C may be configured to have the four-petal shape or any other number of ribs may be used. The ribs prevents (locks) the sleeve 152 from rotating about the main shaft 140.

The sleeve 152 has a length. In a longitudinal middle of the sleeve 152, an opening 159 is formed therein. The moving contact support 150 further comprises a pair of parallel or opposing support panels 153A and 153B which are oriented to be top mounted on the main shaft 140. The panels 153A and 153B align with front and rear edges of the opening 159 and are fixed together via a cross support 153C. As a frame of reference, the support panels 153A and 153B are substantially diametrically opposing the rib 141B. Each of the support panels 153A and 153B has at least one hole 156 formed therein. In the exemplary embodiment, there are two aligned holes.

The opening 159 is dimensioned to track the size of the N channels or recesses 142A, 142B and 142C so that the moving contacts 130 may be recessed in the N channels or recesses 142A, 142B and 142C. The sleeve 152 further includes a pair of shoulders 158A and 158B which are on the exterior sides of the support panels 153A and 153B, respectively.

The main shaft 140 secures the sleeve 152 which is of a tri-petal shape or other multi-rib shape over its inner diameter, preventing installation tolerance. The co-axial degree is good with strong mechanical strength. It increases the insulating distance between phases within the limited space, hence reliability is greatly improved.

Figure 14:
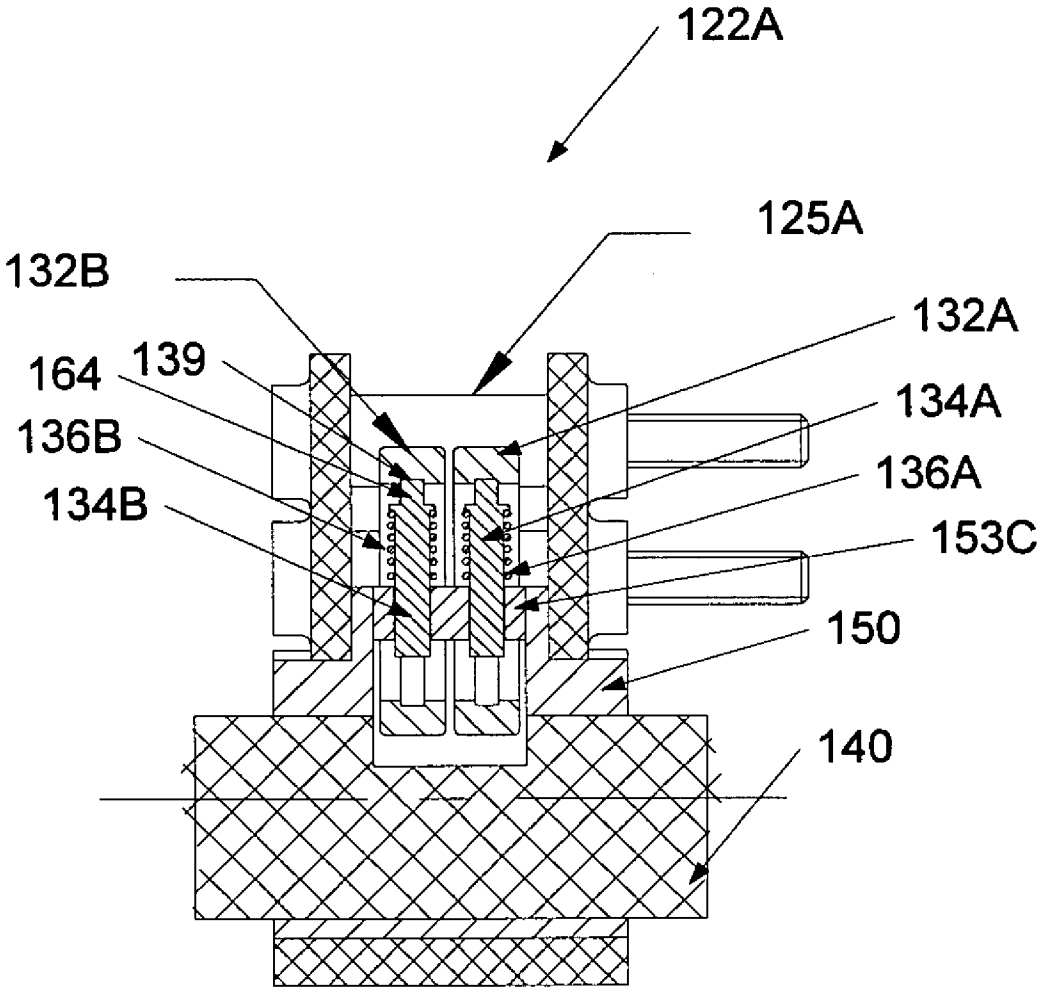
FIG. 14 shows a cross-section view of a circulating circuit of FIG. 6.
Figure 15:
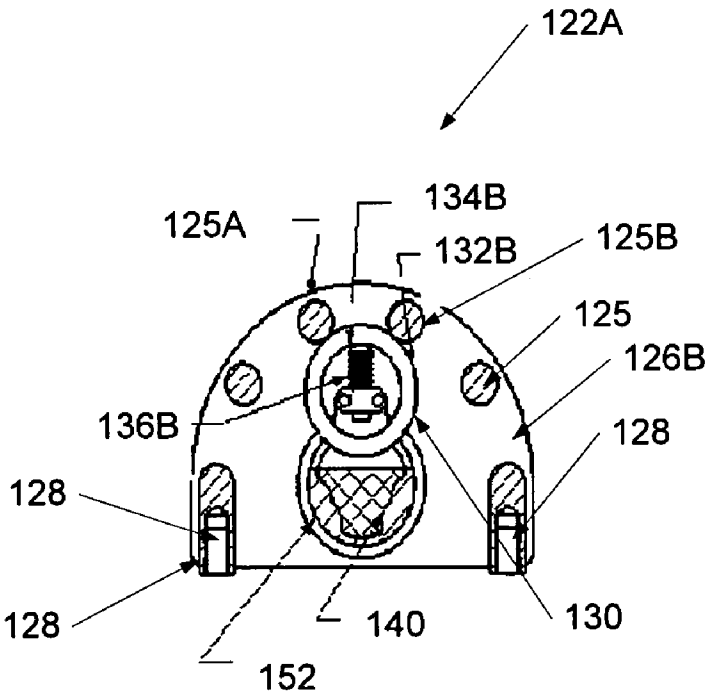
FIG. 15 shows a cross sectional view along the plane 15-15 of FIG. 6.

FIG. 14 shows a cross-section view of a circulating circuit 122A in FIG. 6. FIG. 15 is a cross sectional view along the plane 15-15 of FIG. 6. Since each circulating circuit 122A, 122B and 122C is essentially identical only one such circuit will be described in detail. The circulating circuit 122A is comprised of one moving contact 130 and an array of stationary contacts 125 with at least two adjacent stationary contacts 125A and 125B. The array of stationary contacts 125 includes at least one pair of stationary contacts 125A and 125B. The array of stationary contacts 125 are supported by stationary contact support panels 126A and 126B. The stationary contact support panels 126A and 126B are parallelly aligned and are also parallel to the support panels 153A and 153B.

Figure 16:
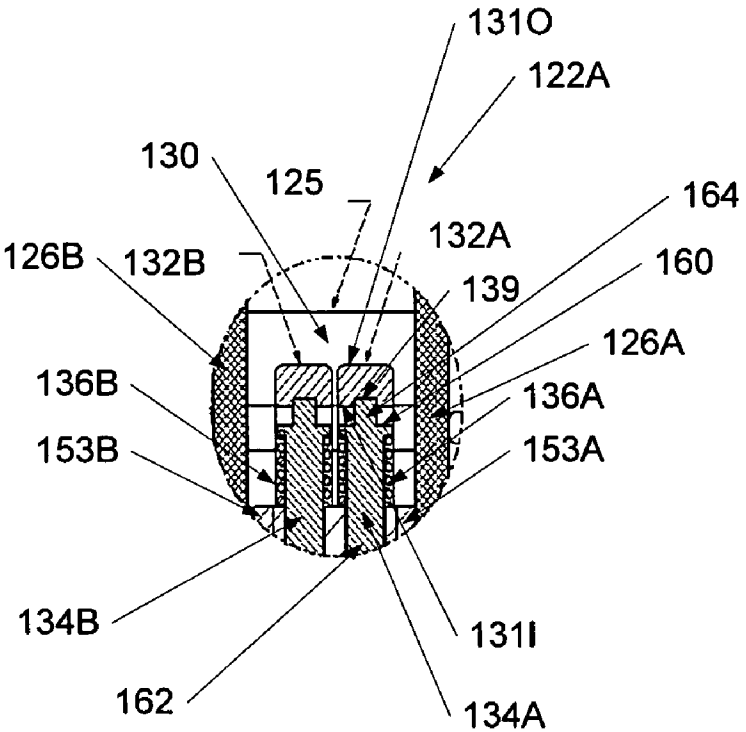
FIG. 16 shows a view of the moving contact.

Through driving, by the main shaft 140, the moving contact 130 is rotated to an angle to mate with another pair of stationary contacts, thus finishing a tap changing operation. FIG. 16 is a view of the moving contact 130. In the exemplary embodiment, the moving contact 130 is comprised of dual rings 132A and 132B in parallel connection, which increase the short circuit capability. Thus, the moving contact 130 is circular. Current carrying capacity can be increased by adding more circular moving contacts 130 and by increasing the length or diameter of the stationary contacts. The width of the recesses 142A, 142B and 142C may also be increased. Nevertheless, one or more rings may be used in the moving contact 130.

The off-circuit tap changer device 120 is used to adjust the output voltage of a transformer by changing its tap winding when the transformer is de-energized. For a three-phase transformer, the tap changer device 120 is a three-phase switch, with and array of six (6) stationary contacts 125 in each phase evenly configured over 180°. There is one moving contact 130 for each phase installed on the main shaft 140. The angle between each neighboring stationary contact 125 of the array is approximately 36°. The shape of stationary (first and last) contacts (denoted as 1 and 6 in FIGS. 17 and 18) is different from the other contacts (denoted as 2, 3, 4, 5 in FIGS. 17 and 18), since the stationary contacts 1 and 6 not only carry current, but also functions as a fixing device. There are threaded holes 127 in or in proximity to the stationary contact 1 and 6, for the fixing to the crossbar member 17 via fastening member 128. The fastening member 128 may be a screw. Nevertheless other fastening arrangements may be substituted for the screw and thread hole arrangement.

Each ring 132A and 132B has an outer perimeter surface 131O intended to contact the two adjacent stationary contacts 125A and 125B. The dual rings 132A and 132B contact the two adjacent stationary contacts 125A and 125B, in parallel, substantially simultaneously and independently. The outer perimeter (circumferential) surfaces 131O of each dual ring 132A and 132B also contacts other stationary contacts of the array of stationary contacts 125 as the moving contact 130 is rotated during tap changing.

Each ring 132A and 132B has an inner circumferential surface 131I. The outer perimeter (circumferential) surface 131O is concentric to the inner circumferential surface 131I. As a point of reference, the inner circumferential surface 131I and the outer perimeter (circumferential) surface 131O together from a circular ring. The inner circumferential surface 131I has a circumferential groove 139 formed 360° therein.

Each ring 132A and 132B of the moving contact 130 is spring biased to the moving contact support 150 via a spring assembly. The spring assembly for ring 132A includes a spring pin 134A and a spring 136A. The spring assembly for ring 132B includes spring pin 134B and a spring 136B. Hence each ring 132A and 132B of the moving contact 130 is independently and individually spring biased. Since each spring pin is essentially identical only one spring pin will be described in detail.

The spring pin 134A is supported above the cross support 153C and has one end coupled in the circumferential groove 139 of a ring (132A or 132B). The spring pin 134A has a main pin body 162 having at one end a stop member 160. The stop member 160 has a circumference or diameter which is keeps the helically wound spring 136A position on the main pin body 162 above the cross support 153C. The other side of the stop member 160 has a connector or point 164 dimensioned to be received and guided in the groove 139. The opposite end of the main pin body 162 includes extends below the cross support 153C. In operation, the spring pin 134A is capable of bobbing (flex) up and down as pressure is exerted and released in during rotation of the circulating circuit. Simultaneously, the ring 132A or 132B independently rolls, as the main shaft 140 is rotated, from one stationary contact to another stationary contact, the spring biased connection to the moving contact support 150A allows the ring 132A or 132B to resiliently flex and simultaneously roll so that there is less wear on the surfaces of the ring 132A and 132B during operation.

In the exemplary embodiment, the moving contact 130 is a rolling, spring-biased moving contact operable to roll freely clockwise or counterclockwise up to 360° independent of the rotation of the main shaft 140 to adjust an output voltage of the transformer 8. Furthermore, each ring of the dual rings is independently spring-biased.

Figure 17:
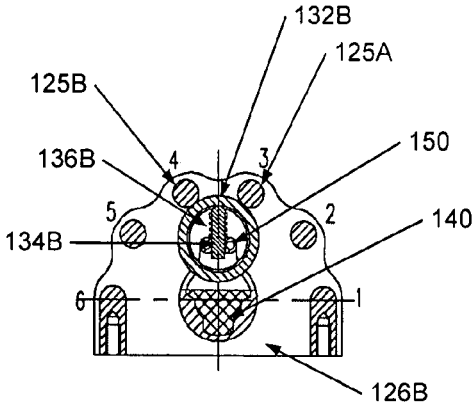
FIG. 17 shows an operational view of the rolling, spring-biased moving contact in a current position.
Figure 18:
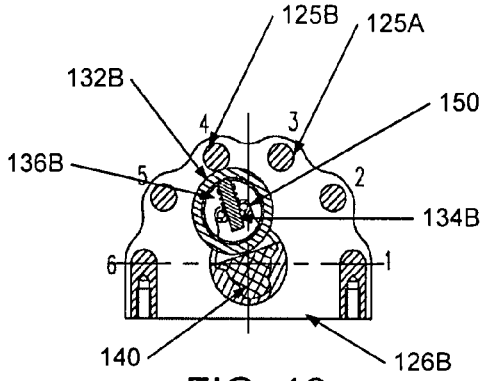
FIG. 18 shows an operational view of the rolling, spring-biased moving contact in a next position.

FIG. 17 shows an operational view of the rolling, spring-biased moving contact 130 in a current position. FIG. 18 shows an operational view of the rolling, spring-biased moving contact 130 in a next position. During tap changing the spring pin (only 134B shown) is independently compressed inside the circumferential groove 139 of the rings 132A and 132B, respectively, of the moving contact 130 and will drive the moving contact 130 in a pure rolling motion, which results in less wearing. The spring (only 136B shown) independently releases its force automatically once it passes a dead point, which will make the moving contact operation precise with obvious handling touch. In these views, the areas above 140 represents a recess in the main shaft 140.

"Rolling" means the relative movement between a moving contact and a stationary contact when making a position change. For each operation switching, the moving contact 130 rotates a certain angle, which is about 36 degree for the exemplary configuration.

In FIG. 17, the current working position is the mid position related to the position of stationary contact 3 (125A). When changing the position from the position of stationary contact 3 (125A) to the position of stationary contact 4 (125B), the handle 16 is turned counter-clockwise, whereby the main shaft 140 together with the moving contact supports 150 rotate, which leads to the rotation of the spring assembly in unison. One end of the spring pin 134B supports against the ring 132B of the moving contact 130, while the other end is inserted in passage or hole of the cross support 153C. As the spring pin 134B rotates is moves along the inner circumference of ring 132B, simultaneously, the ring 132B can roll independently, as shown in FIG. 18.

In FIG. 18, the spring 136B is compressed to the most, which is called the locking point. After passing this position, under the release of the compressed spring force, the moving contact 130 rotates to a position between position 4 and position 5, whereby the stationary contact 4 and stationary contact 5 are bridged and one tap change is accomplished.

The previous description of the disclosed embodiments is provided to enable any person skilled in the art to make or use the disclosure. Various modifications to these embodiments will be readily apparent to those skilled in the art, and the generic principles defined herein may be applied to other embodiments without departing from the spirit or scope of the disclosure. Thus, the disclosure is not intended to be limited to the embodiments shown herein but is to be accorded the widest scope consistent with the principles and novel features disclosed herein.

What is claimed is:

1. A device comprising:

a main shaft adapted to be rotated and including an elongated rod structure having a tri-petal shape contour, a solid center and an outer circumferential surface with a plurality of elongated ribs spaced circumferentially therearound, a top side and a bottom side, said shaft having N recesses formed in the top side wherein N is a number of phases of the transformer, the plurality of elongated ribs having three elongated ribs each of which is separated by a concaved elongated trench; and a plurality of circulating circuits coupled to the main shaft, each circulating circuit having a spring-biased moving contact operable to flex and independently roll about an array of stationary contacts to adjust an output voltage of a transformer by changing its tap winding when the transformer is de-energized.

2. The device of claim 1, wherein the spring-biased moving contact comprises a plurality of rings in parallel and each ring being independently spring-biased and independently free to roll.

3. The device of claim 1 further include a drive mechanism, coupled to rotate said main shaft, having a handle.

4. The device of claim 1 further including a means for rotating the main shaft.

5. The device of claim 1 further comprising N moving contact supports, each moving contact support comprising:

a sleeve with a hollow center contour and being operable to slide along the elongated rod structure;

an opening from in the sleeve; and parallel support panels aligned with two parallel side of the opening and radiating from the sleeve, and being operable to secure the spring-biased moving contact therebetween.

6. The device of claim 5, wherein:

a respective one moving contact support is aligned with a corresponding one recess; and the elongated ribs prevent the N moving contact supports from rotating around the elongated rod structure.

7. The device of claim 5, wherein the spring-biased moving contact comprises a plurality of rings in parallel and each ring being independently spring-biased and independently free to roll.

8. The device of claim 7, wherein said each ring includes an inner circumferential surface having a circumferential groove formed therein; and further comprising:

a spring pin coupled in said circumferential groove of a respective one ring; and a spring coupled to the spring pin to spring bias the respective one ring to the respective one moving contact support.

9. A device comprising:

a main shaft adapted to be rotated and including an elongated rod structure having an outer circumferential surface with a plurality of elongated ribs spaced circumferentially therearound, a top side and a bottom side, with N recesses being formed in the top side wherein N is a number of phases of the transformer;

a plurality of circulating circuits coupled to the main shaft, each circulating circuit having a spring-biased moving contact operable to flex and independently roll about an array of stationary contacts to adjust an output voltage of a transformer by changing its tap winding when the transformer is de-energized; and N moving contact supports, each moving contact support comprising a sleeve with a hollow center contour and being operable to slide along the elongated rod structure, an opening from in the sleeve, and parallel support panels aligned with two parallel side of the opening and radiating from the sleeve, and being operable to secure the spring-biased moving contact therebetween.

10. The device of claim 9 wherein the rod has a solid center, the plurality of elongated ribs includes three elongated ribs and each elongated rib separated by a concaved elongated trench, and the elongated rod structure has a tri-petal shape contour.

11. The device of claim 9 wherein a respective one moving contact support is aligned with a corresponding one recess, and the elongated ribs preventing the N moving contact supports from rotating around the elongated rod structure.

12. The device of claim 9 further include a drive mechanism, coupled to rotate said main shaft, having a handle.

13. The device of claim 9 further including a means for rotating the main shaft.

14. The device of claim 9 wherein the spring-biased moving contact comprises a plurality of rings in parallel and each ring being independently spring-biased and independently free to roll.

15. The device of claim 14 wherein said each ring includes an inner circumferential surface having a circumferential groove formed therein; and further including a spring pin coupled in said circumferential groove of a respective one ring, and a spring coupled to the spring pin to spring bias the respective one ring to the respective one moving contact support.

16. A device comprising:

a main shaft adapted to be rotated and including an elongated rod structure having an outer circumferential surface with a plurality of elongated ribs spaced circumferentially therearound, a top side and a bottom side, with N recesses being formed in the top side wherein N is a number of phases of the transformer;

a plurality of circulating circuits coupled to the main shaft, each circulating circuit having a spring-biased moving contact including a plurality of rings disposed parallel to one another and a subset of said plurality of rings being independently spring-biased, said moving contact operable to flex and independently roll about an array of stationary contacts to adjust an output voltage of a transformer by changing its tap winding when the transformer is de-energized; and N moving contact supports, each moving contact support having a sleeve with a hollow center contour and being operable to slide along the elongated rod structure, an opening from in the sleeve, and parallel support panels aligned with two parallel side of the opening and radiating from the sleeve, and being operable to secure the spring-biased moving contact therebetween.

17. The device of claim 16 wherein each of said plurality of rings roll independently with respect to the remaining rings of said plurality of rings.

18. The device of claim 16 wherein the rod has a solid center, the plurality of elongated ribs includes three elongated ribs and each elongated rib separated by a concaved elongated trench, and the elongated rod structure has a tri-petal shape contour.

19. The device of claim 16 wherein a respective one moving contact support is aligned with a corresponding one recess, and the elongated ribs preventing the N moving contact supports from rotating around the elongated rod structure.

20. The device of claim 16 wherein said each ring includes an inner circumferential surface having a circumferential groove formed therein; and further including a spring pin coupled in said circumferential groove of a respective one ring, and a spring coupled to the spring pin to spring bias the respective one ring to the respective one moving contact support.

21. The device of claim 16 further include a drive mechanism, coupled to rotate said main shaft, having a handle.

22. The device of claim 16 further including a means for rotating the main shaft.

* * * * *